US009396710B2

(12) United States Patent
Gandara

(10) Patent No.: US 9,396,710 B2
(45) Date of Patent: Jul. 19, 2016

(54) FIPPLE (MOUTHPIECE) FOR A WIND MUSICAL INSTRUMENT AND METHOD OF MAKING A FIPPLE FOR A WIND MUSICAL INSTRUMENT

(75) Inventor: Robert Anthony Gandara, Corvallis, OR (US)

(73) Assignee: PIPE MAKERS UNION, LLC, Corvallis, OR (US)

( * ) Notice: Subject to any disclaimer, the term of this patent is extended or adjusted under 35 U.S.C. 154(b) by 332 days.

(21) Appl. No.: 13/370,332

(22) Filed: Apr. 2, 2012

(65) Prior Publication Data

US 2012/0222539 A1 Sep. 6, 2012

Related U.S. Application Data

(60) Provisional application No. 61/446,508, filed on Feb. 25, 2011.

(51) Int. Cl.
*G10D 7/02* (2006.01)
*G10D 9/02* (2006.01)

(52) U.S. Cl.
CPC ..... *G10D 9/02* (2013.01)

(58) Field of Classification Search
USPC ..... 84/383 R
See application file for complete search history.

(56) References Cited

U.S. PATENT DOCUMENTS

| | | | | |
|---|---|---|---|---|
| 2,944,459 | A * | 7/1960 | Simmonds | G10D 7/023 84/380 C |
| 3,030,845 | A * | 4/1962 | Scherer | 84/384 |
| 3,363,497 | A * | 1/1968 | Thompson | G10D 7/023 84/380 C |
| 3,722,348 | A * | 3/1973 | Visser | G10D 7/023 84/380 C |
| 4,683,796 | A * | 8/1987 | Salaman et al. | 84/380 C |
| 7,960,631 | B1 * | 6/2011 | Chang | G10D 7/066 84/382 |
| 2009/0083981 | A1 * | 4/2009 | Wanne | 29/896.22 |

* cited by examiner

*Primary Examiner* — Christopher Uhlir

(57) ABSTRACT

A fipple for a bladed edge or labium lip resonated musical wind instrument, such as a tin whistle, Irish whistle or recorder, is constructed with a windway, blade and mouth. The two-piece tip and body fipple facilitates precise and accurate machined geometries. These geometries include but are not limited to chamfered windway openings and curved labium lips for extra sympathetic harmonics or "tone color". The two-piece design also facilitates the use of two different materials, the tip may be constructed from a material that is comfortable and safe to hold in a human mouth and the body or blade material may be constructed from a metallic material to maximize volume and wind efficiency.

2 Claims, 4 Drawing Sheets

FIPPLE (MOUTHPIECE) FOR A WIND MUSICAL INSTRUMENT AND METHOD OF MAKING A FIPPLE FOR A WIND MUSICAL INSTRUMENT

CROSS-REFERENCE TO RELATED APPLICATIONS

This application claims the benefit of U.S. Provisional application 61/446,508 filed on Feb. 25, 2011, the disclosure of which is incorporated by reference herein in its entirety.

BACKGROUND OF INVENTION

This invention pertains to a fipple for an instrument, such as a tin whistle. The fipple has a two-piece design that facilitates machining of all geometries. The two pieces of the fipple are the tip and the body. Machined geometries of the tip are ergonomic in shape for placement in mouth, including such aspects as windway length, windway cross section, windway chamfer release, position and shape of plug depression. Machined geometries of the body are blade width, blade shape, mouth cross-section and shape and interface to instrument. Also inherent in the design is the self-aligning locking features that enable the windway cross section alignment to the blade and positioning of the plug depression.

The two-piece design also allows for the optimization of material for each piece. The tip may be made from a hard rubber or thermal plastic to enhance player comfort and minimize the risk of an injury to the player. Preferably, the tip is made of Ebonite. The body may be made from non-elastic metallic material and subsequently hardened. The increased stiffness of the blade is designed to increase both the volume and efficiency of the harmonic vibration of the instrument. Preferably, the body is made of anodized aluminum.

Important Geometries

Musical instruments using a fipple mechanism to generate sonic vibration have existed since the $8^{th}$ century. These instruments were originally hand crafted. Manufacturing processes in modem instruments range from formed metal to injection molded plastic. Current methods have inherent limitations of possible shapes and geometric precision.

The basic components of a fipple are the windway, the mouth and the blade. Windway length geometries affect the effect of the musician's embouchure on the instrument. Windway cross section geometries impact the amount of air needed to generate tone. Mouth length geometries affect the ability of the instrument to jump registers. A well-designed instrument should be playable in at least three registers. The width of the mouth defines the volume of the instrument. The shape of the fipple blade is also important to the performance of the instrument. The tone of a straight blade is not as complex as a curved blade. A blunt blade will provide a different response from a beveled or razor sharp blade. The alignment of these three components also has an impact on the volume, efficiency and breathiness of the instruments.

Another geometry associated with advanced fipple design is the plug depression. The plug depression allows for adjustment of intonation accuracy across registers. Also important to the musician is the feel of the instrument during play. The interaction with the lips, teeth and tongue are critical to a successful design. Also important is the instrument bore; larger instruments that produce lower notes require larger bores and a larger diameter fipple. The through bore of the body should be designed to interface with the inner diameter of the instrument. The tuning slide body bore should be precision machined to match with the outer diameter of the instrument in a manner that is adjustable.

Such instruments using a fipple mechanism come in different sizes and keys and all the geometries discussed above may be adjusted for the air pressure range available by the typical human lungs.

The precision and accuracy of all these geometries is critical to crafting or manufacturing a high quality instrument. Not all instrument designs can incorporate all of these features or have the ability to replicate the geometries to the accuracy of 0.001" (0.0254 mm).

BASICS OF INVENTION

Figure 1A:
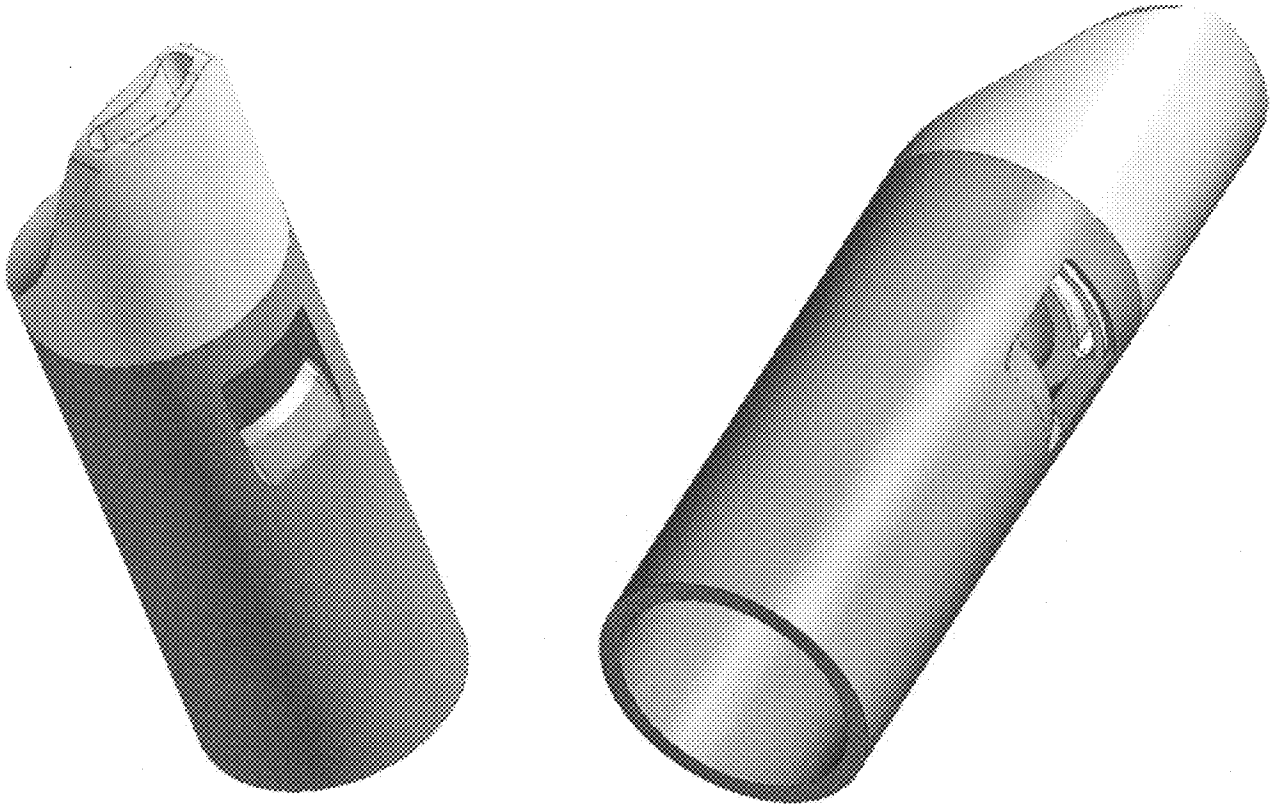
FIG. 1A shows three dimensional Computer Aided Design images of the assembled two piece fipple.
Figure 1B:
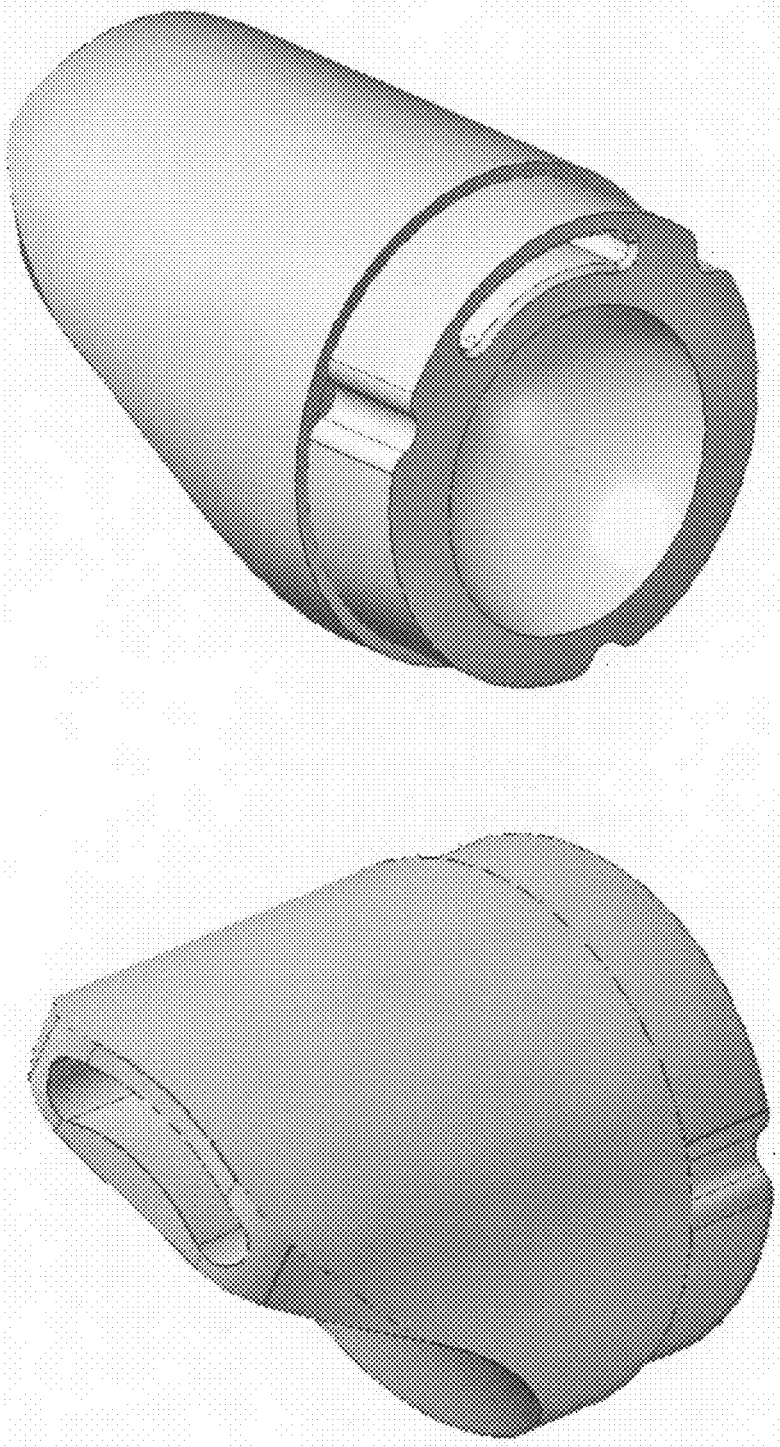
FIG. 1B shows three dimensional Computer Aided Design images of the fipple tip.
Figure 1C:
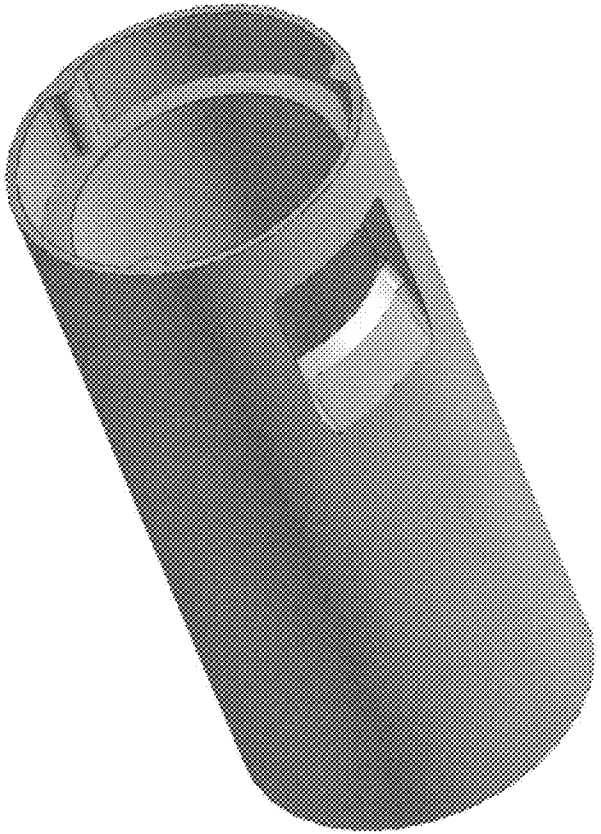
FIG. 1C shows a three dimensional Computer Aided Design image of the fipple body.

The fipple of the present invention comprises a two-piece design as shown in FIG. 1A. The two piece fipple comprises a tip as shown in FIG. 1B and a body as shown in FIG. 1C. The tip may be made from a material that is comfortable in the musician's mouth and the body may be built from a rigid metal to induce the maximum vibration across the blade. With this two-piece design, each piece may be fixtured in a manner to facilitate precise, accurate and repeatable machining of the fipple shape, geometries and assembly alignment keys. This design is fully scalable for an entire family of instruments that are available in different keys, scales, modes and tuning.

Figure 2:
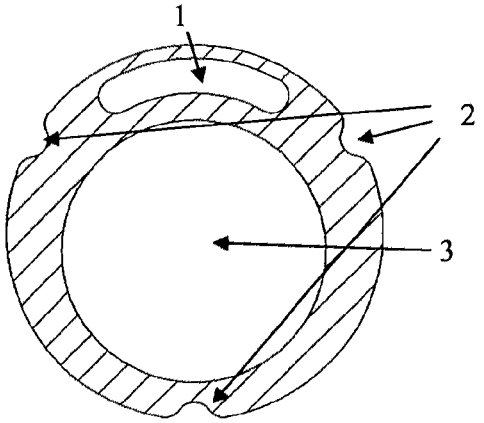
FIG. 2 shows a sample cross-sectional representation of the tip perpendicular to airflow.
Figure 3:
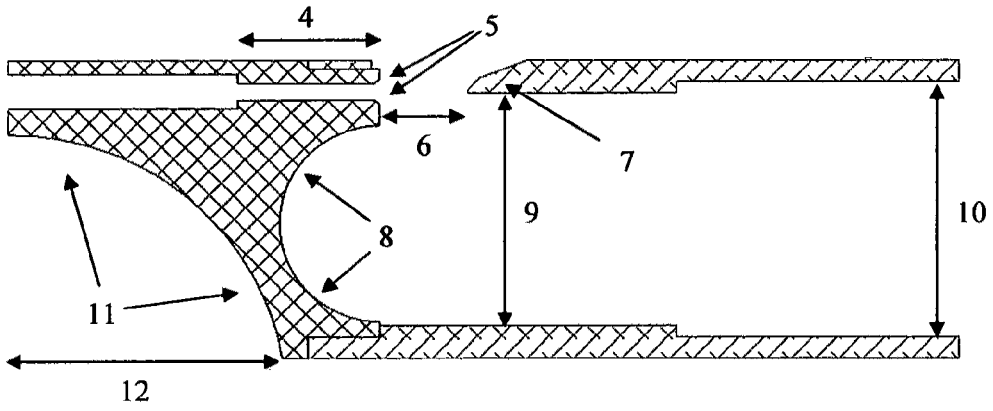
FIG. 3 shows a sample cross-sectional representation of the assembled two piece design parallel to airflow.

Shown in FIGS. 2-3, the geometries machined on the tip include the beak length 12, beak curve 11, fipple outer diameter, windway length 4, windway cross section 1 (height and width), windway exit chamfer 5, windway alignment 2 and plug shape and depth or protrusion 8. With a two-stage windway design, the length of the tip is determined by the comfort of the instrument for engagement in the musicians' mouth.

Figure 4:
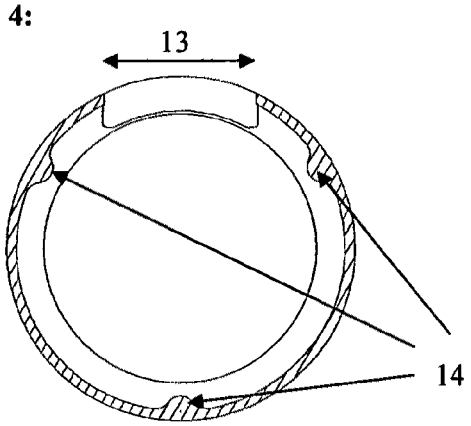
FIG. 4 shows a sample cross-sectional representation of the body perpendicular to airflow detailing alignment keys.

Shown in FIGS. 3-4, The geometries of the body include through bore 9, tuning slide diameter 10, depth of instrument seat, mouth width 13, mouth length 6, blunt height of blade, first blade angle, first blade travel, fundamental blade angle 7 and overall diameter.

All of these factors are modulated and adjusted for each type of instrument and performance characteristics. These instruments are designed to play in different harmonic resonances (registers). All the geometries listed affect the musician's ability to shift between registers easily and maintain proper pitch. A properly designed fipple would allow the typical musician to perform in four registers on an instrument maintaining an accurate pitch center.

With the advent of modern CNC (Computerized Numerical Control) mills, the ability to accurately and precisely create these geometries is available. The design of these geometries on modern computer systems allows for the digital specifications to be downloaded to a machining program.

The two piece fipple design of the present invention takes full advantage of these technological opportunities.

The tip is designed for milling in two steps each with its own fixture. The first position holds the instrument end of the material while the beak arc 11 and windway opening 1 are machined. The tip is then inverted into another fixture compliant with the beak arc for machining the windway 4, windway chamfer 5, body alignment keys 2 and plug depression or protrusion 8.

As a result of this milling process, the tip has a proximal end and a distal end. The proximal end is configured for placement in a user's mouth. The distal end is generally cylindrical in cross-section. The tip includes a beak arc 11 that arcs from the proximal end toward the distal end. The beak arc provides the proximal end with the narrowed shape necessary for the proximal end to be configured for the user's mouth. The beak arc arcs away from the proximal end to accommodate the user's lower lip. The beak arc completes its arc at a point intermediate between the proximal and distal ends. At the proximal end and opposite the beak arc, the proximal end has an opposed surface to accommodate the user's upper lip. The tip includes a windway extending from the proximal end to the distal end adjacent the opposed surface. The windway may be appropriately configured for the size and type of instrument with which the fipple will be used. At the distal end of the tip, the windway includes a windway chamfer 5 configured for the particular instrument or sound desired by the user. The distal end is provided with a step, preferably an external step, and may be provided with alignment keys, preferably indentations, on the tip's outer surface. The distal end may also be provided with a plug depression or protrusion configured for the particular instrument or sound desired by the user. In the preferred embodiment, the plug depression may be a concave hollow in the distal end and.

The body is machined in three steps. First holding the tip end of the instrument, the through bore and tuning slide bore are milled. The part is then inverted and the tip mating diameter and alignment keys 14 are machined. Lastly, the body tube is fixed on a fourth radial axis for machining of the blade shape including but not limited to blunt, first angle, second angle 7 and mouth width 13 and length 6.

As a result of this milling process, the body is generally cylindrical in cross-section and has a proximal end and a distal end. The proximal end is configured with a step, preferably an internal step, and may be provided with alignment keys 14, preferably protrusions. The step of the body is configured to interact with the step of the tip so that the tip and body may be fitted together. The alignment keys of the tip 2 and body 14 may be configured to interact so that the tip and body are properly aligned when the pieces are fitted together. Between the proximal end and the distal end are the mouth, through bore 9 and tuning slide bore 10. The mouth is nearest the proximal end and is positioned to generally align radially with the opposed surface of the tip. The mouth is defined on its distal end by the blade, which includes the blunt, the first angle, and the second angle 7. The width and length of the mouth are configured for the particular instrument or sound desired by the user. The through bore of the body is positioned distal to the windway chamfer and proximal to the tuning slide bore. The through bore may have an inner diameter smaller than that of the tuning slide bore. The distal end of the body is configured to accommodate an instrument body.

With the CNC mill, an optimal tool shape, speed and size is selected for each operation and machining pass. Second pass operations allow for more uniform geometries and cleaner finish for critical geometries.

The method of making the fipple comprises the following steps. Preferably, the proximal end of the tip blank is first milled followed by the distal end, however, the order of milling of the tip blank ends is not critical. In the preferred method, the distal end of the tip blank is fixed to provide access to the proximal end of the tip blank. The proximal end of the tip blank is milled to provide for the beak arc 11 and windway openings 1. The proximal end of the tip blank is then fixed in a fixture compliant with the beak arc 11 to provide access to the distal end of the tip blank. The distal end of the tip blank is then milled to provide the windway 4, windway chamfer 5, body alignment keys 2 and plug depression or protrusion 8.

Regarding the body blank, preferably the distal end of the body blank if first milled, followed by the proximal end and then the additional details are milled, however, the order of the milling of the body blank is not critical. In the preferred method, the proximal end of the body blank is fixed to provide access to the distal end of the body blank. The through bore 9 and tuning slide bore 10 are then milled at the distal end. The distal end is then fixed to provide access to the proximal end. The proximal end is milled to provide the tip mating diameter and alignment keys 14. The body blank is then fixed on a fourth radial axis for machining of the blade shape including the blunt, first angle, second angle 7 and mouth width 13 and length 6.

What is claimed is:

1. A fipple for a bladed edge or labium lip resonated musical wind instrument, comprising: a tip and a body;

the tip is of a unitary construction and has an outer surface, a first proximal end, and a first distal end;

the tip includes a beak arc that arcs from the first proximal end toward the first distal end; the beak arc provides the first proximal end with a narrowed shape necessary for the first proximal end to be configured for a user's mouth and to accommodate a user's lower lip; the beak arc completes its arc at a point intermediate between the first proximal end and the first distal end;

the tip includes an opposed surface as part of the outer surface; the opposed surface is opposite the beak arc, extends from the first proximal end of the tip to the first distal end of the tip, and provides a surface adjacent to the first proximal end to accommodate a user's upper lip;

the tip includes a windway adjacent to the opposed surface and extending from the first proximal end to the first distal end; the windway includes a chamfer at the first distal end of the tip;

the tip includes a first step at the first distal end; the first step is configured to engage the body;

the body is of a unitary construction and has an inside surface, and outside surface, a second proximal end and a second distal end; the body includes a second step at the second proximal end configured to engage the first step of the tip;

the body has a mouth adjacent the second proximal end and positioned so that the mouth aligns radially with the opposed surface of the tip and is adjacent the windway of the tip when the tip and the body are joined;

the body has a blade immediately distal to the mouth; the blade is substantially wedge-shaped and has a first angled surface extending between the mouth and the outside surface of the body; wherein the blade includes a blunt and a second angled surface extending between the mouth and the outside surface of the body; and the distal end of the body is configured to accommodate an instrument body.

2. A fipple for a bladed edge or labium lip resonated musical wind instrument, comprising: a tip and a body;

the tip is of a unitary construction and has an outer surface, a first proximal end, and a first distal end;

the tip includes a beak arc that arcs from the first proximal end toward the first distal end; the beak arc provides the first proximal end with a narrowed shape necessary for the first proximal end to be configured for a users mouth and to accommodate a user's lower lip; the beak arc completes its arc at a point intermediate between the first proximal end and the first distal end;

the tip includes an opposed surface as part of the outer surface; the opposed surface is opposite the beak arc, extends from the first proximal end of the tip to the first distal end of the tip, and provides a surface adjacent to the first proximal end to accommodate a user's upper lip;

the tip includes a windway entirely immediately adjacent to the opposed surface and extending from the first proximal end to the first distal end; the windway providing the sole passage for airflow within the tip directly from the first proximal end to the first distal end; the windway includes a chamfer at the first distal end of the tip;

the tip includes a first step at the first distal end; the first step is configured to engage the body;

the body is of a unitary construction and has an inside surface, and outside surface, a second proximal end and a second distal end; the body includes a second step at the second proximal end configured to engage the first step of the tip;

the body has a mouth adjacent the second proximal end and positioned so that the mouth aligns radially with the opposed surface of the tip and is adjacent the windway of the tip when the tip and the body are joined;

the body has a blade immediately distal to the mouth; the blade is substantially wedge-shaped and has a first angled surface extending between the mouth and the outside surface of the body; wherein the blade includes a blunt and a second angled surface extending between the mouth and the outside surface of the body; and the distal end of the body is configured to accommodate an instrument body.

* * * * *